US009696661B1

(12) United States Patent
DeVore et al.

(10) Patent No.: US 9,696,661 B1
(45) Date of Patent: Jul. 4, 2017

(54) METHODS FOR RETRYING PICK IN AN IMAGE-BEFORE-PICK SYSTEM

(71) Applicant: Lexmark International, Inc., Lexington, KY (US)

(72) Inventors: Benjamin Charles DeVore, Lexington, KY (US); Delbert Lester Elliott, Georgetown, KY (US); James Marion Nimmo, Georgetown, KY (US); David Anthony Schneider, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/140,846

(22) Filed: Apr. 28, 2016

(51) Int. Cl.
*G03G 15/16* (2006.01)

(52) U.S. Cl.
CPC ..... *G03G 15/1605* (2013.01)

(58) Field of Classification Search
CPC ..... G03G 15/6511; G03G 15/6555; G03G 15/6558; G03G 2215/00409
See application file for complete search history.

(56) References Cited

U.S. PATENT DOCUMENTS

| | | | | |
|---|---|---|---|---|
| 3,655,282 | A * | 4/1972 | Turner | G03G 15/26 399/168 |
| 4,751,484 | A * | 6/1988 | Matsumoto | G03G 15/50 399/25 |
| 8,654,384 | B2 * | 2/2014 | Kamomae | G06F 3/121 358/1.14 |
| 2012/0050808 | A1 * | 3/2012 | Kamomae | G06F 3/121 358/1.15 |
| 2014/0056629 | A1 * | 2/2014 | Obata | G03G 15/6529 399/389 |
| 2014/0126938 | A1 * | 5/2014 | Hogan | G03G 15/0194 399/302 |
| 2015/0061217 | A1 * | 3/2015 | Minakuchi | B65H 3/44 271/258.01 |

FOREIGN PATENT DOCUMENTS

JP 2003330289 A * 11/2003

* cited by examiner

*Primary Examiner* — Sevan A Aydin
(74) *Attorney, Agent, or Firm* — Adam J. Ahne; John Victor Pezdek

(57) ABSTRACT

A method of operating an imaging device is disclosed. The imaging device is designed to start the imaging process before picking a sheet. During a pick retry, the device waits to start the imaging process until after the sheet is picked successfully. This method improves pick reliability and reduces wasted toner. Other systems and methods are disclosed.

6 Claims, 4 Drawing Sheets

METHODS FOR RETRYING PICK IN AN IMAGE-BEFORE-PICK SYSTEM

CROSS REFERENCES TO RELATED APPLICATIONS

None.

BACKGROUND

1. Field of the Disclosure

The present disclosure relates generally to imaging devices and more particularly to methods for recovering from a fail to pick in an imaging device.

2. Description of the Related Art

Imaging devices may be architected as pick-before-image systems that wait to begin an imaging process until after media has been successfully picked i.e. successfully singulated from a stack of media. If the first pick attempt fails, such a system may retry the pick multiple times without wasting toner or causing extra wear on imaging components.

In contrast, image-before-pick systems begin an imaging process before media has been successfully picked. Such systems may provide faster throughput than pick-before-image systems. However, if the initial pick fails, toner will be wasted since the system is architected with the assumption that a sheet of media will be at a transfer position when the imaging system is ready to transfer toner to the sheet. If the first pick attempt fails, toner is wasted and extra wear occurs on the imaging components for each pick retry. What is needed is a method of operating an image-before-pick system that wastes less toner and reduces wear on the imaging components.

SUMMARY

The invention, in one form thereof, is directed to a method of operating an imaging device including placing a first row of toner corresponding to a first row of an image onto an intermediate transfer mechanism (ITM); activating a pick mechanism a first time to attempt singulating a sheet from a stack of media; and determining whether the singulating was successful. Upon a negative determination, cleaning the first row of toner off the ITM, activating the pick mechanism a second time to attempt to singulate the sheet from the stack of media, placing a second row of toner corresponding to the first row of the image onto the ITM, and transferring the second row of toner to the sheet. Upon a positive determination the first row of toner is transferred to the sheet.

The invention, in another form thereof, is directed to a method of operating an imaging device including starting a first instance of an imaging process before making a first pick attempt of a first sheet, determining whether the first pick attempt failed, upon a positive determination making a second pick attempt of the first sheet then starting a second instance of the imaging process, and transferring toner to the first sheet. The second instance of the imaging process includes putting the toner on an intermediate transfer mechanism that is free of toner.

The invention, in another form thereof, is directed to a method of operating an imaging device including beginning to place an image onto an intermediate transfer mechanism (ITM); making a first pick attempt to singulate a sheet from a stack of media; and determining whether the sheet arrived at an input sensor within a timeout period. Upon a positive determination, the sheet is transported to meet the image on the ITM. Upon a negative determination, stopping placing the image onto the ITM, cleaning the image from the ITM, making a second pick attempt to singulate the sheet, and determining whether the sheet arrived at the input sensor within the timeout period. Upon a negative determination an error is reported via an operator interface. Upon a positive determination delaying the sheet before it arrives at the ITM, restarting placing the image onto the ITM, and transporting the sheet to meet the image on the ITM.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
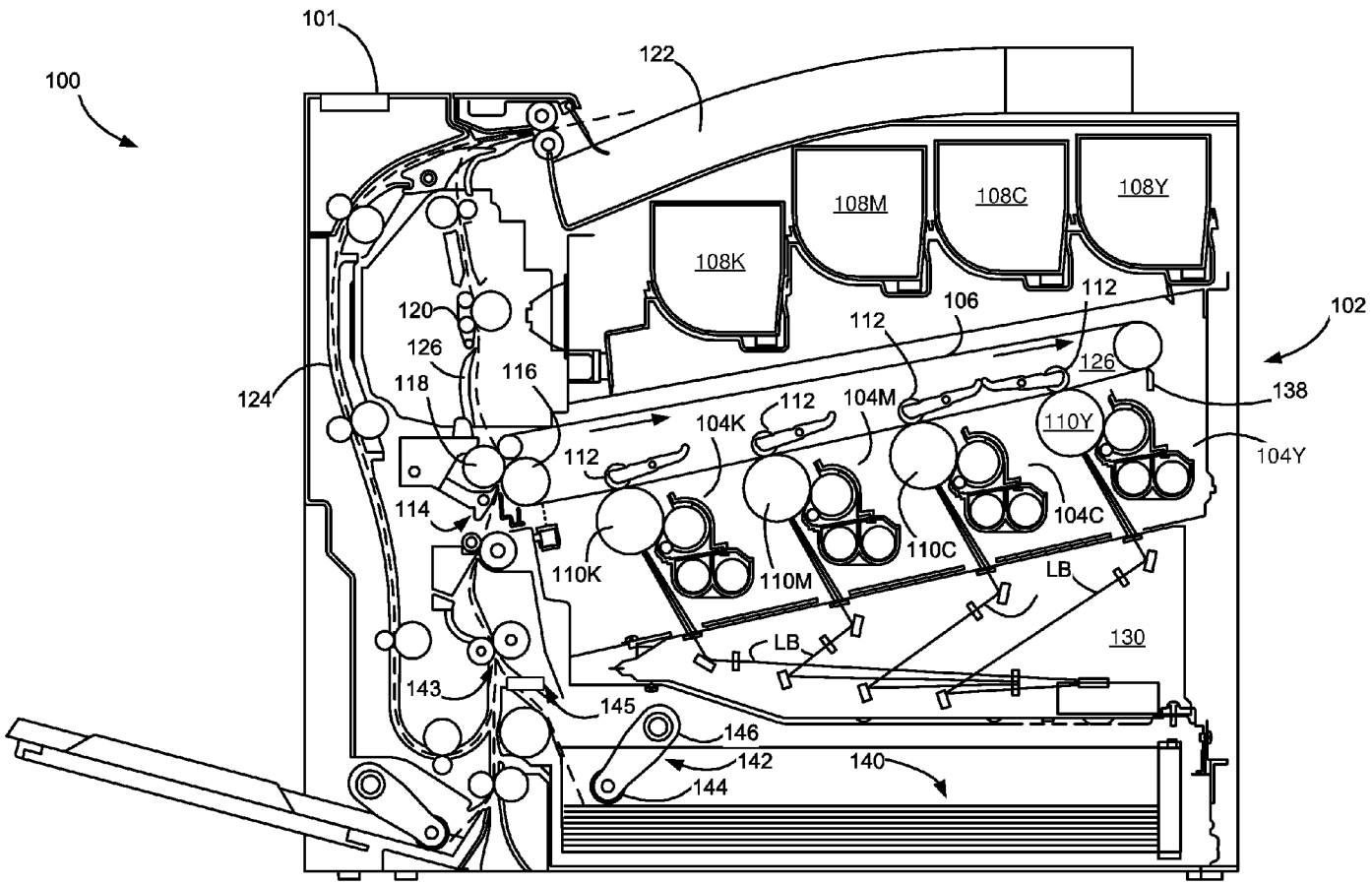
FIG. 1 is a block diagram of an imaging system including an image forming device according to one example embodiment.

Referring to the drawings and particularly to FIG. 1, which illustrates a color image forming device 100 according to an example embodiment. Image forming device 100 has an operator interface 101 having, for example, status LEDs. Image forming device 100 includes a first transfer area 102 having four developer units 104 that substantially extend from one end of image forming device 100 to an opposed end thereof. Developer units 104 are disposed along an intermediate transfer member belt 106. Each developer unit 104 holds a different color toner. Developer units 104 may be aligned in order relative to the direction of ITM belt 106 indicated by the arrows in FIG. 1, with the yellow developer unit 104Y being the most upstream, followed by cyan developer unit 104C, magenta developer unit 104M, and black developer unit 104K being the most downstream along ITM belt 106.

Each developer unit 104 is operably connected to a toner reservoir 108 for receiving toner for use in an imaging operation. Each toner reservoir 108 is controlled to supply toner as needed to its corresponding developer unit 104. Each developer unit 104 is associated with a photoconductive member 110 that receives toner therefrom during toner development to form a toned image thereon. Each photoconductive member 110 is paired with a transfer member 112 for use in transferring toner to ITM belt 106 at first transfer area 102.

During color image formation, the surface of each photoconductive member 110 is charged to a specified voltage, such as −800 volts, for example. At least one laser beam (LB) from a printhead 130 is directed to the surface of each photoconductive member 110 and discharges those areas it contacts to form a latent image thereon. Each laser beam scans along a line parallel to an axis of rotation of each photoconductive member 110. Each laser beam is turned on and off as it scans along the photoconductive member 110 based on the corresponding row of an image being printed as is known in the art. A row of toner will adhere to this line as described below. In one example embodiment, areas on the photoconductive member 110 illuminated by the laser beam LB are discharged to approximately −100 volts. Each of developer units 104 then transfers toner to its corresponding photoconductive member 110 to form a toner image thereon. The toner is attracted to the areas of the surface of photoconductive member 110 that are discharged by the laser beam LB from the printhead 130.

ITM belt 106 is disposed adjacent to each developer unit 104. In this example embodiment, ITM belt 106 is formed as an endless belt disposed about a drive roller and other rollers. During image forming operations. ITM belt 106 moves past photoconductive members 110 in a clockwise direction as viewed in FIG. 1. One or more of photoconductive members 110 applies its toner image in its respective color to ITM belt 106. For mono-color images, a toner image is applied from a single photoconductive member 110K. For multi-color images, toner images are applied from two or more photoconductive members 110. In one example embodiment, a positive voltage field formed in part by transfer member 112 attracts the toner image from the associated photoconductive member 110 to the surface of moving ITM belt 106.

Thus, this example imaging process includes exposing a photoconductive member by a laser beam, transferring toner from a developer unit to the exposed areas of the photoconductive member, and transferring the toner from the photoconductive member to an ITM. The process to transfer toner to the media and to fuse the toner will be described below.

ITM belt 106 rotates and collects the one or more toner images from the one or more developer units 104 and then conveys the one or more toner images to a media sheet at a second transfer area 114. Second transfer area 114 includes a second transfer nip formed between at least one backup roller 116 and a second transfer roller 118. Cleaner 138 scrapes any remaining toner off of the ITM before the ITM returns to the photoconductive members 110.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

A sheet is singulated from a stack of media 140 by a pick mechanism 142 and moved along a paper path (shown in dashed lines) to a nip 143 between feed rollers and then moved up to the second transfer area 114. An input sensor 145 such as, for example, an opto-interrupter with a flag, detects the presence of media within the paper path and is used to determine if a pick was successful. The pick mechanism 142 includes a pick tire 144 rotationally mounted to the end of an arm 146 that pivots about an end opposite the pick tire 144 to maintain contact between the pick tire 144 and the stack of media 140 as the stack of media 140 varies in height. The pick tire 144 is driven by a motor to singulate, i.e. separate from the stack of media, a single sheet. Other pick mechanisms are known in the art and may be substituted for pick mechanism 142.

During normal operation, the color image forming device 100 is an image-before-pick system i.e. the imaging process begins before making the first pick attempt. If the first pick attempt fails, the toner on the ITM is cleaned from the ITM and discarded. The imaging process is paused until a second or later pick attempt succeeds to avoid wasting additional toner and the color image forming device 100 temporarily switches to a pick-before-image system. Preferably, the second pick is slower, i.e. the pick tire 144 is rotated more slowly during the second pick than the first pick, which results in a more reliable pick. Once a sheet is successfully picked it is paused or slowed between nip 143 and second transfer area 114 until the toner on the ITM catches up to the sheet. Once the sheet reaches the second transfer area 114 the sheet is moved at normal process speed. Subsequent pages are processed as normal i.e. image-before-pick. Alternatively, if multiple pick failures occur from the same media source, e.g. five pick failures, subsequent pages may be pick-before-image until the next time that media source is accessed by a user, the next power on reset cycle, etc.

Figure 2:
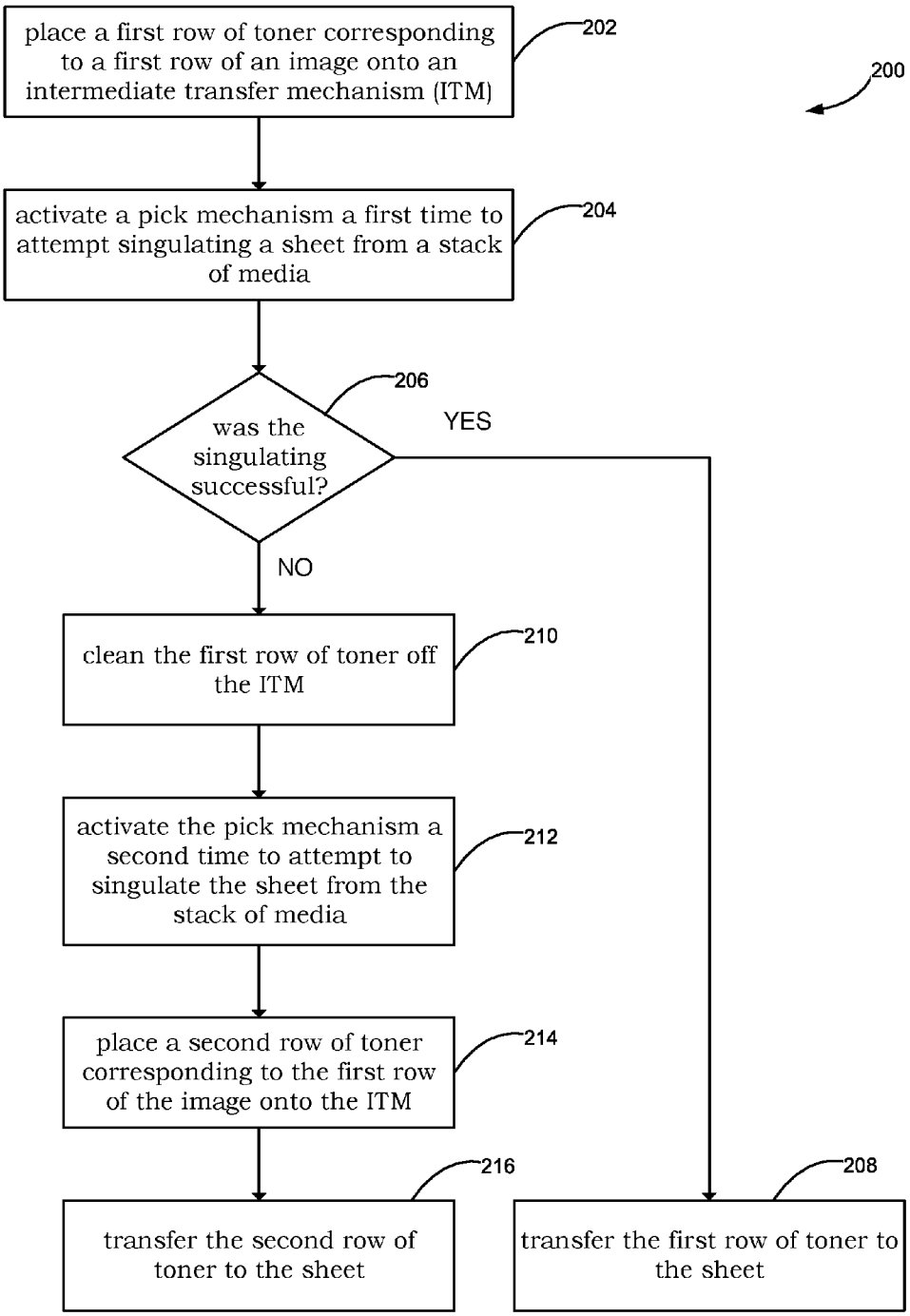
FIG. 2 is a flowchart of a method of operating an image forming device.

FIG. 2 shows an example embodiment of a method of operating an imaging device according to one embodiment. Method 200 reduces wasted toner due to pick failures while improving the reliability of pick retries for an image-before-pick system.

At block 202, a first row of toner is placed onto an ITM. The first row of toner corresponds to a first row of an image. An image may be defined by a two-dimensional array of pixels containing rows and columns. There may be a one-to-one relationship between the first row of toner and the pixels in the first row of the image. Alternatively, there may be a mapping algorithm that relates the placement of toner to the pixels in the image as is know in the art e.g. half-toning, etc.

At block 204, a pick mechanism is activated a first time to attempt to singulate a sheet from a stack of media. Block 206 determines whether the singulating was successful. Upon a positive determination, at block 208 the first row of toner is transferred to the sheet. Upon a negative determination, at block 210 the first row of toner is cleaned off the ITM. At block 212 the pick mechanism is activated a second time to attempt to singulate the sheet from the stack of media. The second pick may drive a pick tire at a slower speed than the first pick to improve the reliability of the singulating. If the second pick us not successful, an alert may be presented to a user via an operator interface. Alternatively, multiple retries may be attempted before alerting the user. At block 214 a second row of toner is placed corresponding to the first row of the image onto the ITM. It is necessary to place this second row of toner because the first row of toner has been cleaned off the ITM due to the constraints of the mechanism as shown in FIG. 1. At block 216 the second row of toner is transferred to the sheet. The sheet may be stopped after activating the pick mechanism the second time and before transferring the second row of toner to the sheet to give the ITM time to catch up to the sheet.

Figure 3:
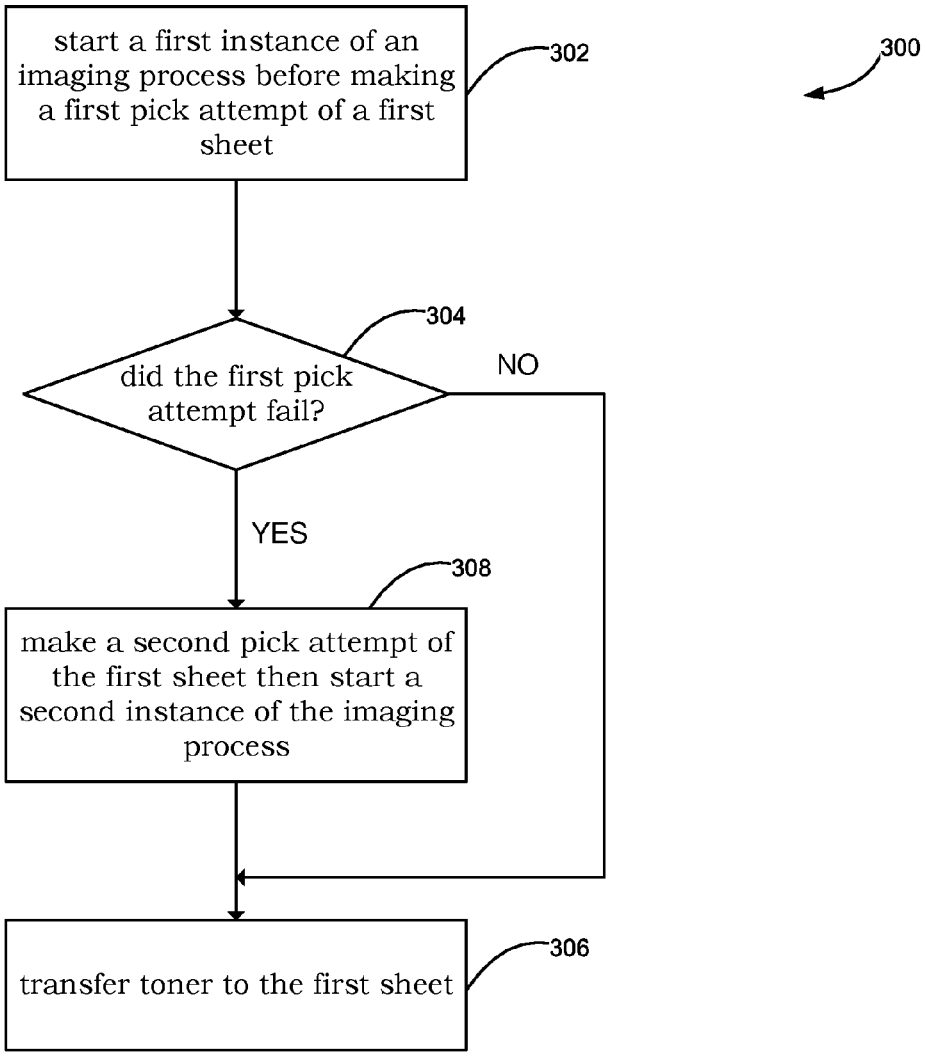
FIG. 3 is a flowchart of a method of operating an image forming device.

FIG. 3 shows an example embodiment of a method of operating an imaging device according to one embodiment. Method 300 reduces wasted toner due to pick failures while improving the reliability of pick retries for an image-before-pick system.

At block 302, a first instance of an imaging process is started before making a first pick attempt of a first sheet. The imaging process includes putting toner on an ITM that is free of toner, e.g. an ITM that has been cleaned by a cleaner, etc. The imaging process is an image-before-pick process. At block 304 it is determined whether the first pick attempt failed. If it did not fail, at block 306 toner is transferred to the first sheet.

If the first pick attempt failed, at block 308 a second pick attempt of the first sheet is made then a second instance of the imaging process is started. At block 306 toner is transferred to the first sheet. The second pick attempt may be performed at a slower pick speed than the first pick attempt.

The method may further determine whether more than a threshold number of pick attempts failed from a media source. The threshold may be, for example, five pick failures. Upon a positive determination, the method may wait to start the imaging process until after successfully picking each sheet from the media source until one of a user interacts with the media source and the imaging device is turned off. Example media sources include a paper tray, a single sheet feeder, etc.

Figure 4:
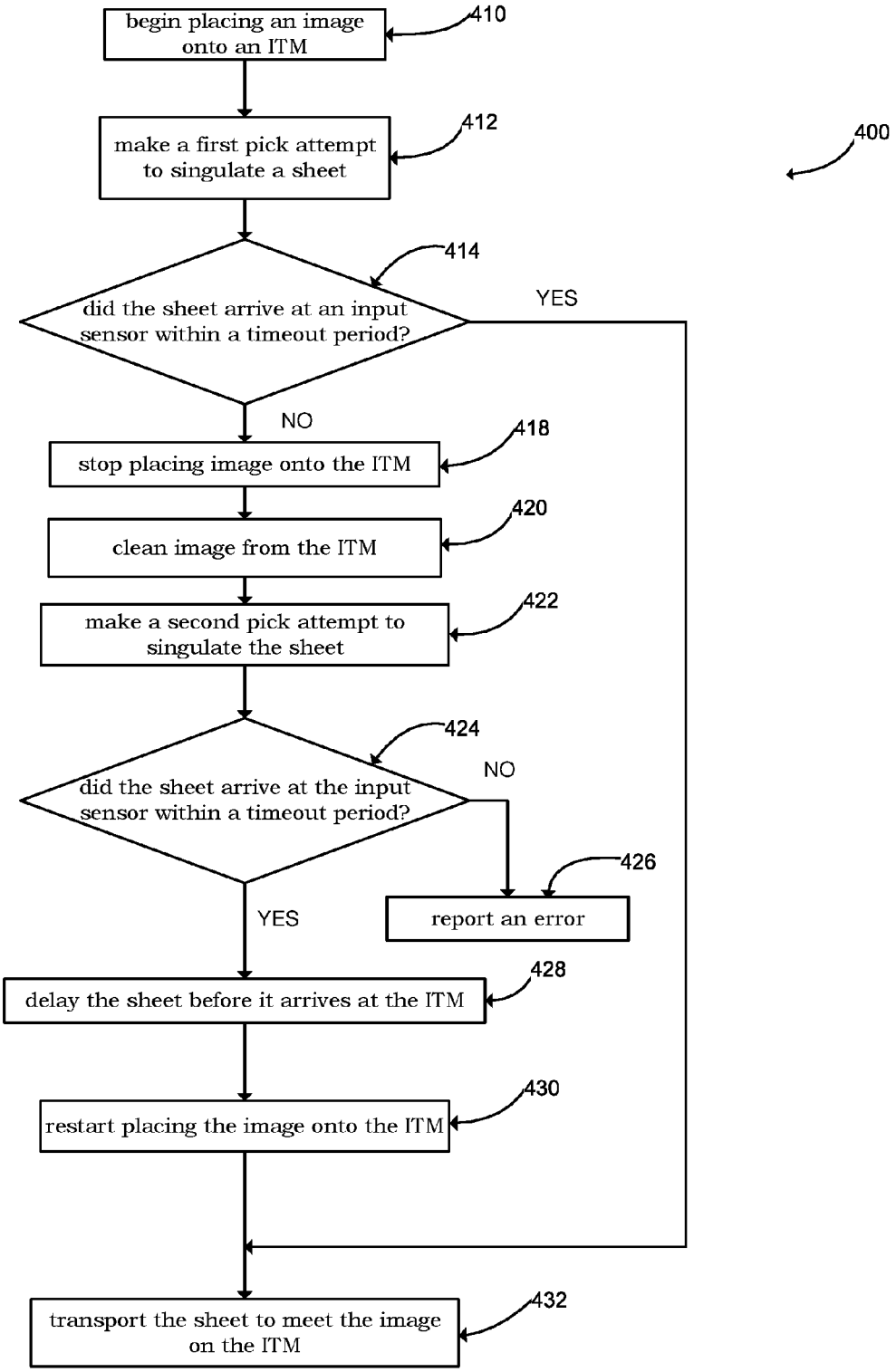
FIG. 4 is a flowchart of a method of operating an image forming device.

FIG. 4 shows an example embodiment of a method of operating an imaging device according to one embodiment. Method 400 reduces wasted toner due to pick failures while improving the reliability of pick retries for an image-before-pick system.

At block 410, the method begins placing an image onto the ITM e.g. toner is transferred to the ITM corresponding to the image. At block 412, a first pick attempt is made to singulate a sheet from a stack of media. At block 414, it is determined whether the sheet arrived at an input sensor within a timeout period. Upon a positive determination, at block 432 the sheet is transported to meet the image on the ITM at, for example, a second transfer area.

Upon a negative determination, at block 418 placing the image onto the ITM is stopped. At block 420, the image is cleaned from the ITM. At block 422, a second pick attempt to singulate the sheet is made. At block 424, it is determined whether the sheet arrived at the input sensor within the timeout period. Upon a negative determination, at block 426 an error is reported via an operator interface. The system may wait for a user to clear the error.

Upon a positive determination, at block 428 the sheet is delayed before it arrives at the ITM. The delaying may include slowing the sheet, stopping the sheet, etc. At block 430 placing the image onto the ITM is restarted. At block 432 the sheet is transported to meet the image on the ITM.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments. Method acts may be performed in alternate orders.

What is claimed is:

1. A method of operating an imaging device comprising:
placing a first row of toner corresponding to a first row of an image onto an intermediate transfer mechanism (ITM);
activating a pick mechanism a first time to attempt singulating a sheet from a stack of media;
determining whether the singulating was successful;
upon a negative determination,
cleaning the first row of toner off the ITM,
activating the pick mechanism a second time to attempt to singulate the sheet from the stack of media,
placing a second row of toner corresponding to the first row of the image onto the ITM,
transferring the second row of toner to the sheet; and
upon a positive determination transferring the first row of toner to the sheet,
wherein the activating the pick mechanism the first time includes driving a pick tire at a first rotation speed, the activating the pick mechanism the second time includes driving the pick tire at a second rotation speed, and the first rotation speed is greater than the second rotation speed.

2. The method of claim 1, further comprising stopping the sheet after activating the pick mechanism the second time and before transferring the second row of toner to the sheet.

3. A method of operating an imaging device comprising:
starting a first instance of an imaging process before making a first pick attempt of a first sheet;
determining a first determination whether the first pick attempt failed;
upon a positive first determination making a second pick attempt of the first sheet then starting a second instance of the imaging process; and
transferring toner to the first sheet,
wherein the second instance of the imaging process includes putting the toner on an intermediate transfer mechanism that is free of toner and the second pick attempt is performed at a slower pick speed than the first pick attempt.

4. The method of claim 3, further comprising determining a second determination whether more than a threshold number of pick attempts failed from a media source and upon a positive second determination waiting to start the imaging process until after successfully picking each sheet from the media source until one of a user interacts with the media source and the imaging device is turned off.

5. A method of operating an imaging device comprising:
beginning to place an image onto an intermediate transfer mechanism (ITM);
making a first pick attempt to singulate a sheet from a stack of media;
determining a first determination whether the sheet arrived at an input sensor within a timeout period;
upon a positive first determination, transporting the sheet to meet the image on the ITM;
upon a negative first determination,
stopping placing the image onto the ITM,
cleaning the image from the ITM,
making a second pick attempt to singulate the sheet,
determining a second determination whether the sheet arrived at the input sensor within the timeout period,
upon a negative second determination report an error via an operator interface,
upon a positive second determination
delaying the sheet before it arrives at the ITM,
restarting placing the image onto the ITM, and
transporting the sheet to meet the image on the ITM,
wherein the delaying the sheet includes slowing the sheet.

6. The method of claim 5, wherein the delaying the sheet includes stopping the sheet.

* * * * *